US006135937A

United States Patent [19]

Ballos, III

[11] Patent Number: 6,135,937

[45] Date of Patent: Oct. 24, 2000

[54] MOVEABLE TAPE HEAD FOR ERECTING MACHINE

[76] Inventor: Pete Ballos, III, 161 Harter Ave., NW., Canton, Ohio 44708

[21] Appl. No.: 09/183,480

[22] Filed: Oct. 30, 1998

[51] Int. Cl.[7] ..... B31B 1/72

[52] U.S. Cl. ..... 493/116; 493/117; 493/478

[58] Field of Search ..... 53/136.4; 493/116, 493/117, 382, 383, 478; 156/486–492

[56] References Cited

U.S. PATENT DOCUMENTS

| | | | |
|---|---|---|---|
| 3,196,591 | 7/1965 | Guido et al. | 53/137 |
| 3,775,937 | 12/1973 | Devan et al. | 53/136.4 |
| 4,213,285 | 7/1980 | Mancini | 53/137 |
| 4,224,781 | 9/1980 | Salenbo | 53/473 |
| 4,285,679 | 8/1981 | Wahle | 493/125 |
| 4,437,851 | 3/1984 | Salenbo | 493/124 |
| 4,438,617 | 3/1984 | Ulrich et al. | 53/136.4 |
| 4,585,504 | 4/1986 | Marchetti | 53/136.4 |
| 4,592,188 | 6/1986 | Marchetti | 493/117 |
| 4,643,707 | 2/1987 | Marchetti | 493/117 |
| 4,781,786 | 11/1988 | Lerner et al. | 53/136.4 |
| 5,372,569 | 12/1994 | Ballos, III | 493/316 |
| 5,374,326 | 12/1994 | Marchetti | 156/468 |
| 5,626,708 | 5/1997 | Vasilakes et al. | 156/468 |
| 5,685,814 | 11/1997 | Le | 493/117 |
| 5,687,543 | 11/1997 | Lam | 53/136.4 |
| 5,772,568 | 6/1998 | Chen | 493/117 |
| 5,916,106 | 6/1999 | Chen | 53/136.4 |

*Primary Examiner*—Eugene Kim
*Attorney, Agent, or Firm*—Sand & Sebolt

[57] ABSTRACT

A moveable tape head mechanism for a box erecting machine having a fixed guide rail and an adjustable guide rail includes a cradle which carries a tape head, the cradle being horizontally slidable between operational and loading positions to expedite replacement of a tape roll contained thereon. In the operational position, the tape head mechanism is detachably held by a pin in operational alignment with a box flap closure apparatus. The tape head mechanism is moved from the operational positional to the loading position by installing a cover plate over the tape head to compress the rollers into the tape head, disengaging the pin from its corresponding receptacle formed on the flap closure apparatus, and sliding the tape head mechanism under a frame member and outside the perimeter of the box erecting machine. When the tape head is in the loading position, the tape roll is located outside the perimeter of the box erecting machine to facilitate replacement thereof. After the tape roll has been replaced, the tape head mechanism is slid back to the operational position with the pin slidably engaging a ramp surface and returning into engagement with the receptacle, thus automatically realigning the tape head mechanism with the flap closure apparatus.

33 Claims, 6 Drawing Sheets

MOVEABLE TAPE HEAD FOR ERECTING MACHINE

BACKGROUND OF THE INVENTION

1. Technical Field

This invention relates generally to box erecting machines and, more particularly, to a moveable tape head for a box erecting machine. Specifically, the invention relates to an adjustable tape head that can be horizontally moved between an operational position internal to the box erecting machine operationally and adjustably aligned with the box folding structure and a loading position outside the perimeter of the box erecting machine to facilitate replacement of the tape roll.

2. Background Information

Essentially all commercial goods travel through commerce enclosed in some type of packaging. Among the most common types of packaging are boxes (also referred to as carton or cases) of a rectangular solid shape and that are typically manufactured of corrugated cardboard. Such boxes are of innumerable shapes and sizes suited to the specific needs of the packaging application. One such type of box is a parallelepiped carton with inward-turned flaps on at least the bottom thereof.

Unassembled parallelepiped cartons are typically cut from a single sheet of material and then formed into a generally tubular configuration having four sides. Each side terminates with a top flap and a bottom flap at opposed ends thereof. The top flaps and bottom flaps are folded inwardly and sealed to form top and bottom sides, respectively. Such boxes are typically shipped from a box manufacturer in a flat configuration as blanks and must be assembled into a three-dimensional box prior to use. Such assembly can be by hand or through the use of a box erecting machine.

The flaps of a box are designated in the art as "major" and "minor" depending on their relative length. For instance, in a parallelepiped box having a length, a width, and a height, with the length and width being unequal, the major flaps are the two opposed flaps lying adjacent the longer of the length and width, with the minor flaps being the flaps adjacent the shorter of the length and the width. While many parallelepiped boxes contain bottom-forming flaps and top-forming flaps, some parallelepiped boxes contain only bottom-forming flaps, with the fully assembled box having an open top.

Parallelepiped boxes are assembled by first drawing the unassembled, flat box into a generally tubular rectangular shape. The minor flaps are each folded 90 degrees inward, with the major flaps then being folded 90 degrees inward and over the minor flaps. The flaps are then sealed in place using glue, adhesive tape, gummed tape, or other such materials that are known and understood in the relevant art.

The bottom flaps of a parallelepiped box often are fully assembled first with the top flaps being left open or unassembled so that the box can be filled with the appropriate contents. After the box has been filled, the final step is to fold and seal the top flaps of the box. The top flaps are sealed in a manner similar to the sealing of the bottom flaps, i.e., folding the minor flaps 90 degrees inward, folding the major flaps 90 degrees inward and over the minor flaps, and then sealing the major flaps in position with glue, adhesive tape, gummed tape, or the like.

Such operations often are performed as part of an assembly line operation with the unfolded boxes being loaded into a magazine, each box being opened in turn and the bottom flaps thereof sealed to form a bottom. The boxes are then appropriately filled and the top flaps thereof sealed.

When adhesive tape is utilized to seal the flaps of the box, the tape is typically delivered from a large roll attached to a tape head of the type known and understood in the relevant art. Inasmuch as the tape is consumed from the roll, such rolls of tape require periodic replacement. Such replacement can be both time consuming and expensive inasmuch as the assembly line typically must be cleared prior to replacement of the tape roll. Thus, the need exists for a taping mechanism for a box erecting machine wherein the tape roll can be easily replaced with a minimum of downtime and effort.

Box erecting machines of the type described above are rather complex and expensive machines that are permanently installed in production lines and are capable of being set up to assemble boxes of different sizes. Such machines typically contain adjustable guide rails that maintain the boxes in proper orientation over the folding and taping structures of the machine.

One such type of box erecting machine utilizes a stationary guide rail and an adjustable guide rail that is adjusted to correspond with width of the box being assembled. As is understood in the relevant art, the major flaps of a box are taped, typically in a single operation, at the center of the box width. When the adjustable side rail is adjusted to accommodate a box of a different width, the center line of the box where the folding and taping operations occur is shifted laterally. Thus, a box erecting machine having a fixed guide rail and an adjustable guide rail must additionally contain an adjustment system that permits the box folding and taping structures to correspondingly move with the center line of the box.

One reason for designing machinery to contain a fixed guide rail and a moveable guide rail with correspondingly moveable box folding and taping structures is to permit the boxes, as they are assembled, to travel along a fixed, constant "index" line. Inasmuch as the boxes are assembled for the purpose of carrying goods, the goods must, at some point, be loaded into the boxes. Boxes traveling through a production line along a fixed index line are more easily filled than boxes that are delivered centered along a conveyor system because such centered boxes typically require a longer reach by the individual who loads or the machinery that loads the box. Cartons traveling along a common index line can be filled directly from the index line with minimal reach and minimal wasted effort. Additionally, the use of a common index line for filling boxes expedites the setup of automated machinery used to fill the boxes.

One type of box erecting machine known in the art is described in U.S. Pat. No. 5,374,326 to Marchetti. The machinery disclosed therein permits boxes to be assembled, but does not provide for the assembly and delivery of boxes along a common, fixed index line. Thus, while the invention disclosed in Marchetti can assemble boxes of different widths, Marchetti does not disclose an invention that can assemble boxes of different widths and deliver the boxes along a common index line. Moreover, Marchetti discloses a box sealing structure that is upwardly removable from a box erecting machine requiring maintenance or reloading to be performed while reaching and leaning over the machine.

Other box erecting machines share this drawback. The tape heads are often tucked under the assembly line and are difficult to reach by a person changing the tape roll. The person changing the tape roll is often uncomfortable and off balance, conditions that increase the risk of injury or harm to the machine and to the person.

An improved device overcoming the limitations of other devices known in the art would preferably include a tape head mechanism that is horizontally adjustable to correspond with boxes of different widths and is horizontally removable from the box erecting machine for replacement of the tape roll. Such a device would then allow the tape head mechanism to be readily and automatically alignable with the box folding structures of the box erecting machine. Thus, the need exists for a box erecting machine that can assemble boxes of different widths and deliver the boxes along a common index line with the tape roll of the machine being readily replaceable by the user.

SUMMARY OF THE INVENTION

In view of the foregoing, an objective of the invention is to provide a box erecting machine having a tape head mechanism that is adjustable to suit cartons of various widths.

Another objective of the present invention is to provide a box erecting machine having a tape head mechanism that is slidably adjustable.

Another objective of the present invention is to provide a box erecting machine having a tape head mechanism horizontally moveable between an operational position internal to the box erecting machine and a loading position outside the perimeter of the box erecting machine.

Another objective of the present invention is to provide a box erecting machine having a tape head mechanism with a tape roll that is readily replaceable.

Another objective of the present invention is to provide a box erecting machine having a tape head mechanism that is detachably alignable with the box folding structures of the machine.

Another objective of the present invention is to provide a box erecting machine having a tape head mechanism that is slidably mounted on horizontal bars.

Another objective of the present invention is to provide a box erecting machine that assembles at least the lower half of a carton and includes a moveable tape head assembly.

Another objective of the present invention is to provide a box erecting machine that supplies assembled boxes along a common index line, and includes a tape roll that is readily replaceable.

These and other objectives and advantages of the invention are obtained from the moveable tape head for box erecting machine, the general nature of which can be stated as including a frame defining a structural perimeter of the machine, guide means mounted on the frame for guiding the box, the guide means defining an operational perimeter of the machine, conveyance means for conveying the box through the guide means, a cradle selectively movably mounted on the frame, a tape head having at least a first outwardly-biased roller, the tape head mounted in the cradle, and the cradle being selectively moveable between a loading position outside the operational perimeter and an operational position inside the operational perimeter.

BRIEF DESCRIPTION OF THE DRAWINGS

The preferred embodiment of the invention, illustrative of the best mode in which applicant has contemplated applying the principles of the invention, is set forth in the following description and is shown in the drawings and is particularly and distinctly pointed out and set forth in the appended Claims.

Similar numerals refer to similar parts throughout the specification.

DESCRIPTION OF THE PREFERRED EMBODIMENT

Figure 1:
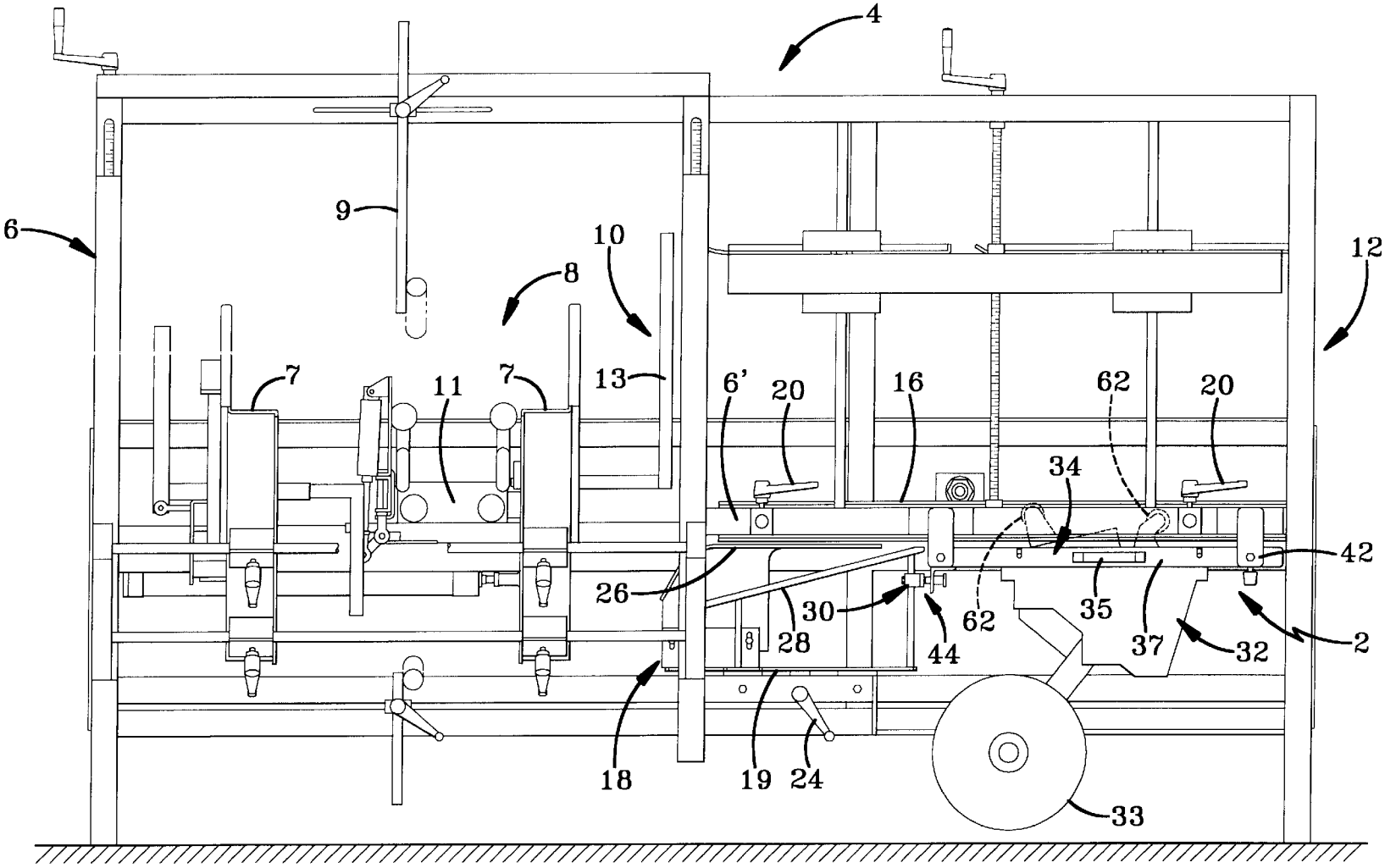
FIG. 1 is a front elevational view of a box erecting machine containing the moveable tape head of the present invention.
Figure 2:
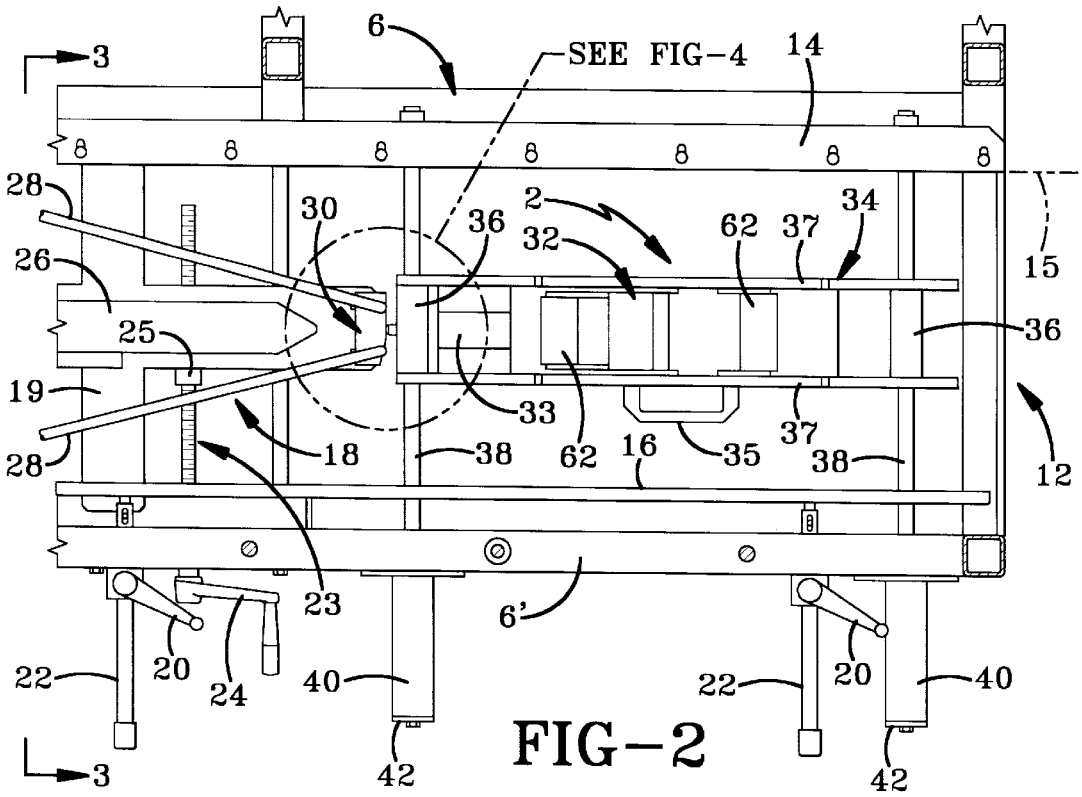
FIG. 2 is a plan view of the moveable tape head of the present invention in an operational position taken immediately above the tape head.
Figure 5:
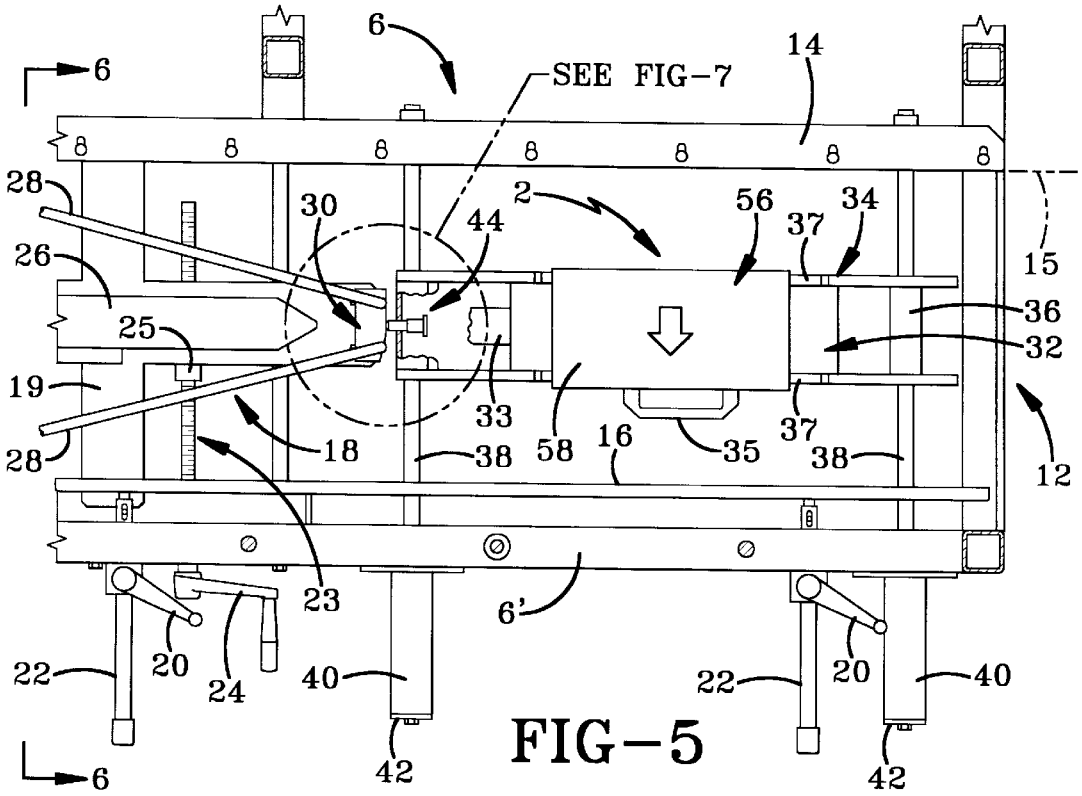
FIG. 5 is a view similar to FIG. 2 with portions removed and with a cover plate installed on the tape head.

The moveable tape head mechanism of the present invention is indicated generally by the numeral 2 in the accompanying drawings. Tape head mechanism 2 is a component of a box erecting machine 4 of the type generally known and understood in the relevant art. Box erecting machine 4 is a machine that assembles boxes from a flat, unassembled configuration to a parallelepiped configuration with an assembled bottom and an open or unassembled top.

Box erecting machine 4 includes a frame 6 that carries various components. Box erecting machine 4 includes a magazine 8, an inlet 10, and an outlet 12. Magazine 8 includes a pair of feed trays 7 and a spring bar 9. Boxes (not shown) in a flat, unassembled configuration are placed in feed trays 7 of magazine 8 and held in place by spring bar 9. A suction puller 11 pulls a box on demand from magazine 8 and delivers it to inlet 10. In passing from inlet 10 to outlet 12, the unassembled box is opened to parallelepiped form and the bottom flaps of the box are folded and taped by structures to be described below to form a box having an assembled bottom.

Boxes are pushed through box erecting machine 4 from inlet 10 in the direction of outlet 12 by a push bar 13 (FIG. 1) that advances the box a given distance, rotates upwardly through an angle of approximately 90 degrees, and is then retracted toward inlet 10 where it is lowered to its original position for pushing another box through box erecting machine 4. Push bar 13 is depicted in FIG. 1 in the upward, non-retracted position.

Boxes being pushed through box erecting machine 4 pass between and are held in rectangular alignment by a fixed guide rail 14 and an adjustable guide rail 16 parallel and spaced apart from fixed guide rail 14. Fixed guide rail 14 is fixedly attached to frame 6. In accordance with the objective of the invention, the edge of fixed guide rail 14 facing adjustable guide rail 16 provides an index line 15 against which all boxes passing through box erecting machine 4 are aligned.

An operational perimeter is defined between imaginary planes extending vertically from the surfaces of guide rails 14 and 16 facing one another, the planes being substantially parallel with each other. Folding and taping operations that are performed on boxes occur inside the operational perimeter. The operational perimeter of box erecting machine 4 thus varies with the position of adjustable guide rail 16.

Adjustable guide rail 16 is selectively lockable by the action of a pair of locking levers 20 that selectively lock a pair of lock bars 22 that are each fixedly attached to adjustable guide rail 16 and slide through a hole in frame 6. Adjustable guide rail 16 is adjusted by releasing locking levers 20, adjusting adjustable guide rail 16 to the desired position between minimum inward and maximum outward limiting positions depending upon the width of the box to be assembled and engaging locking levers 20 to lock adjustable guide rail 16 in the desired position.

Guide rails 14 and 16 align boxes over a flap closure apparatus 18 and tape head mechanism 2. Both the folding operation carried out by flap closure apparatus 18 and the taping function performed by tape head mechanism 2 are performed at the center of the width of the box as it passes between guide rails 14 and 16. Inasmuch as fixed guide rail 14 remains fixed and adjustable guide rail 16 is adjusted to suit the width of the particular box being assembled, flap closure apparatus 18 and tape head mechanism 2 must be centered between guide rails 14 and 16 prior to operation of box erecting machine 4, as is set forth more fully below.

Flap closure apparatus 18 includes a fold plate 26, a pair of deflection bars 28, and a locking plate 30 attached to a mounting plate 19. A crank assembly 23 includes a threaded centering crank 24 rotatably mounted to frame 6 and operating threadably with a cooperatively threaded block 25 attached to mounting plate 19. In other embodiments not shown, locking plate 30 could be directly attached to block 25. Crank assembly 23 adjusts and centers flap closure apparatus 18 between guide rails 14 and 16 by rotation of centering crank 24. Fold plate 26 (FIG. 1) folds the leading flap of the box inwardly as the box passes fold plate 26. Deflection bars 28 are a pair of elongated bars that extend generally upwardly and inwardly in the downstream direction from inlet 10 toward outlet 12. After the leading flap of the box has been folded inwardly (i.e., rearwardly) by fold plate 26, the flaps parallel with rails 14 and 16 contact deflection bars 28 and are folded inward thereby toward one another. As is known in the art, box erecting machine 4 has an additional mechanism (not shown) that folds the trailing flap of the box immediately after its removal from magazine 8 by suction plate 11 and prior to its being pushed in the downstream direction over flap closure apparatus 18 by push bar 13.

In passing over flap closure apparatus 18, the flaps of the box have been folded such that the leading and trailing flaps (minor flaps) are folded inward with the flaps adjacent rails 14 and 16 (major flaps) folded inward over them. With the bottom flaps folded as such, the box is then directed to tape head mechanism 2 for the taping operation.

Figure 3:
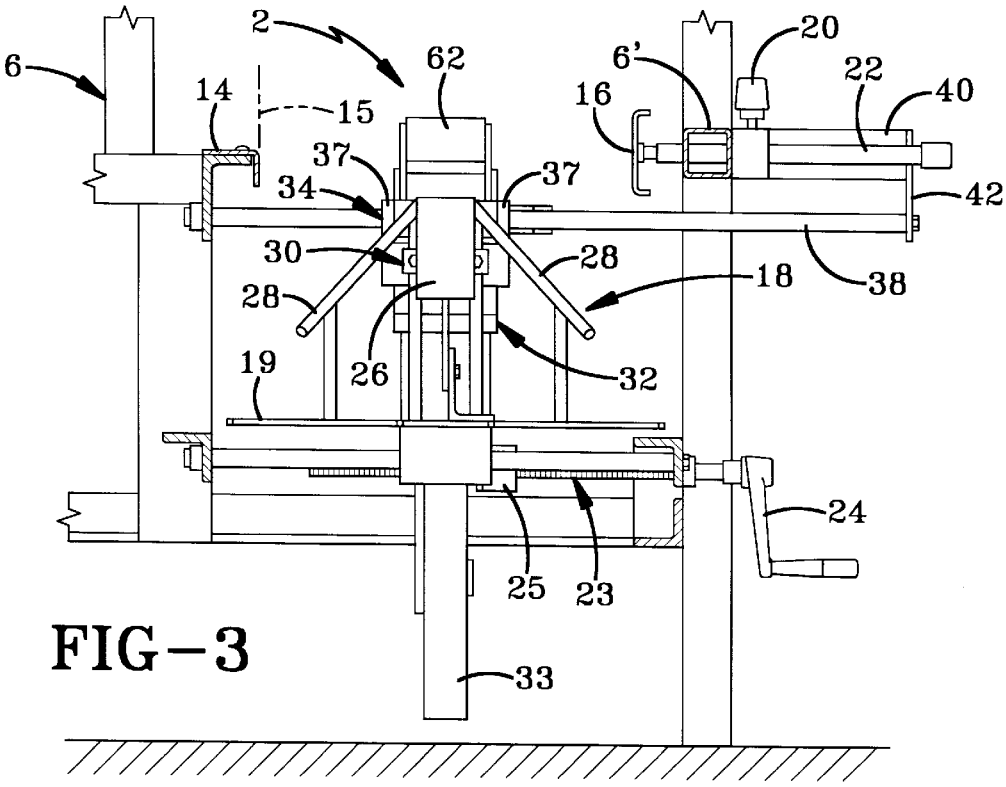
FIG. 3 is a left side elevational section view of the moveable tape head taken along line 3—3 of FIG. 2.
Figure 6:
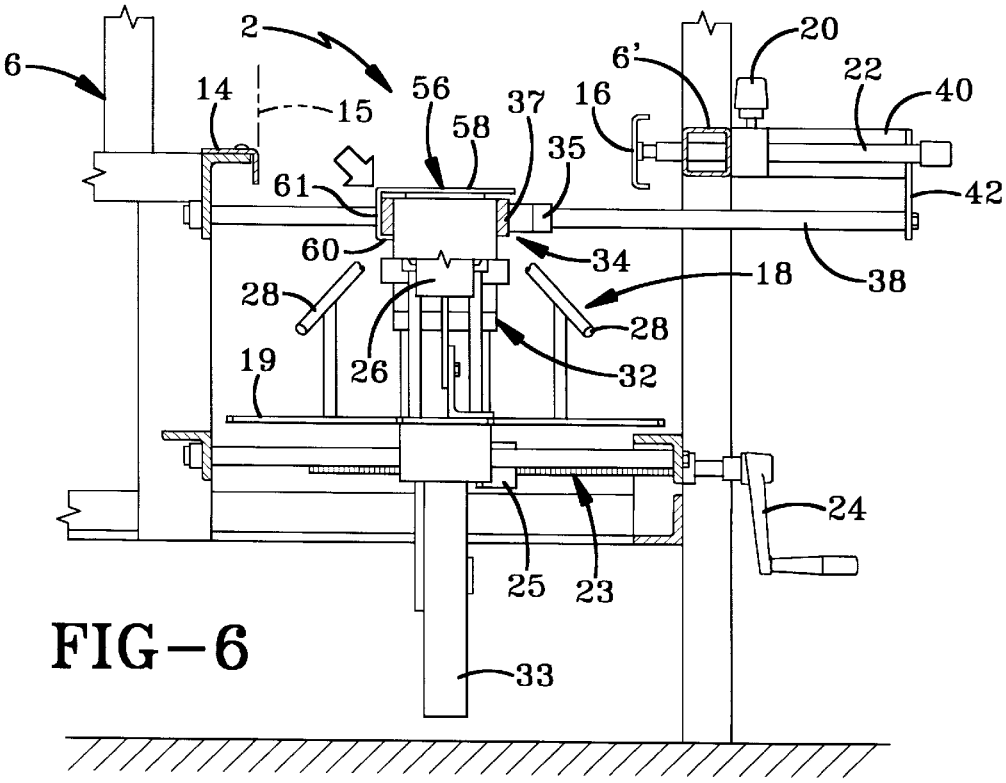
FIG. 6 is a view taken along line 6—6 of FIG. 5 with portions removed and with the cover plate installed on the tape head.
Figure 4:
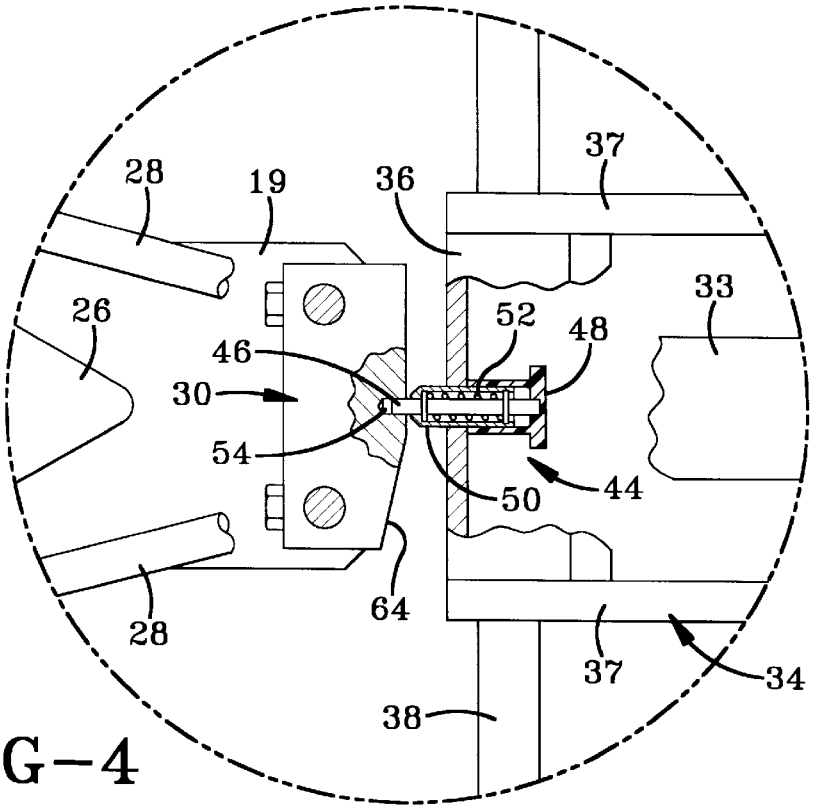
FIG. 4 is an enlarged view of the encircled portion of FIG. 2.
Figure 7:
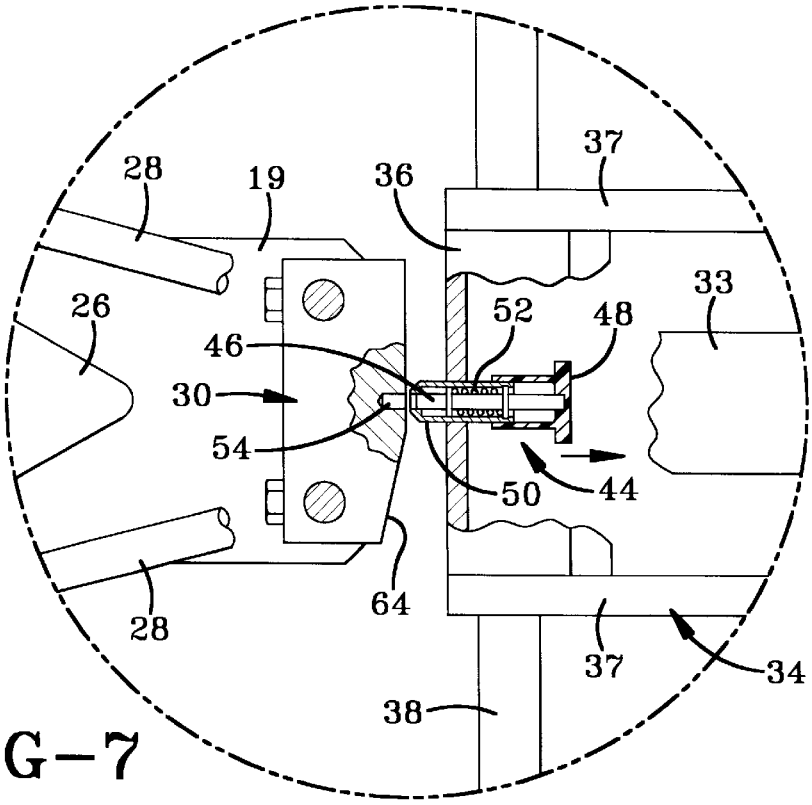
FIG. 7 is an enlarged view of the encircled portion of FIG. 5.
Figure 9:
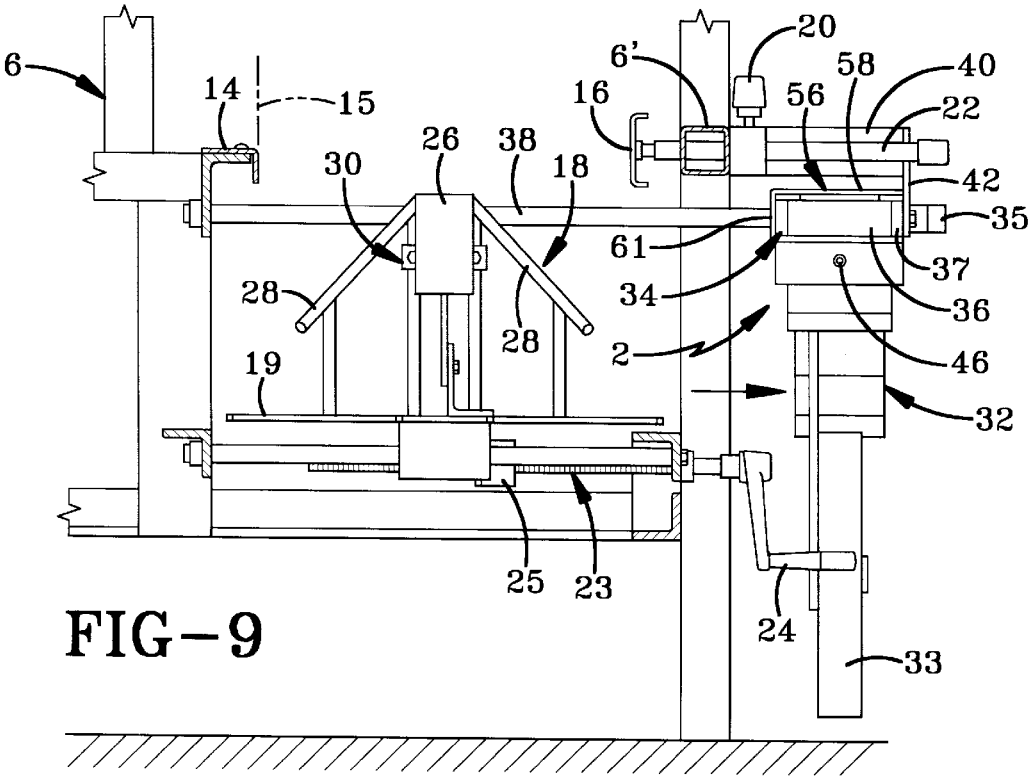
FIG. 9 is a left side elevational section view taken along line 9—9 in FIG. 8.

Tape head mechanism 2 includes a tape head 32, a cradle 34 in which tape head 32 is mounted, a handle 35 attached to cradle 34, and a pair of collars 36 attached to cradle 34. In accordance with the features of the invention, a bar 38 slides through each of collars 36, thus permitting collars 36 and, in turn, cradle 34 and tape head 32, to be slidably adjustable along bars 38. Bars 38 are fixedly attached to brackets 40 which are, in turn, fixedly attached to and extend outwardly from frame 6. Thus, as is shown in FIGS. 3, 6, and 9, and in accordance with the features of the present invention, brackets 40 permit bars 38 to extend outwardly from and beyond the perimeter of frame 6. Brackets 40 each terminate in a butt plate 42. Tape head mechanism 2 additionally includes a pin assembly 44 and a cover plate 56, both of which are more fully described below.

Tape head 32 is a conventional tape head of the type known and understood in the relevant art. Tape head 32 may, for instance, be an ACCUGLIDE® II Taping Head manufactured by the Minnesota Mining and Manufacturing Co. of Minneapolis, Minn., although other tape heads may be used without departing from the spirit of the present invention. Tape head 32 has a spool for carrying a tape roll 33 and additionally includes a plurality of rollers 62 that press the tape from tape roll 33 into adhesive contact with the box. As is understood in the relevant art, rollers 62 are biased to the upward position shown in FIG. 1 and can be pressed inward into tape head 32 by an appropriately applied downward compressive force.

Cradle 34 of tape head mechanism 2 is formed of a pair of parallel, rectangular plates 37 separated by collars 36. Collars 36 are elongated hollow substantially cylindrical bodies, each formed with a substantially cylindrical hole therein. Each collar 36 is slidingly disposed on one of bars 38. As indicated hereinbefore, and in accordance with the features of the present invention, cradle 34, and thus tape head 32 installed in cradle 34, are horizontally slidable along bars 38.

As indicated hereinbefore, the taping operation occurs centrally between guide rails 14 and 16, and collars 36 of tape head mechanism 2 permit cradle 34 and tape head 32 to slidably move along bars 38. Pin assembly 44 is employed to align cradle 34 in an operational position with flap closure apparatus 18. Pin assembly 44 includes a pin 46, a pull knob 48 connected to pin 46, a sleeve 50 through which pin 46 telescopes, and a spring 52 for biasing pin 46 toward a receptacle 54 formed on locking plate 30.

In operation, pin 46 is received in receptacle 54 of locking plate 30, thus holding cradle 34 and tape head 32 of tape head mechanism 2 in operational alignment with flap closure apparatus 18, and thus defining the operational position for tape head mechanism 2 depicted in FIGS. 1–7.

Figure 8:
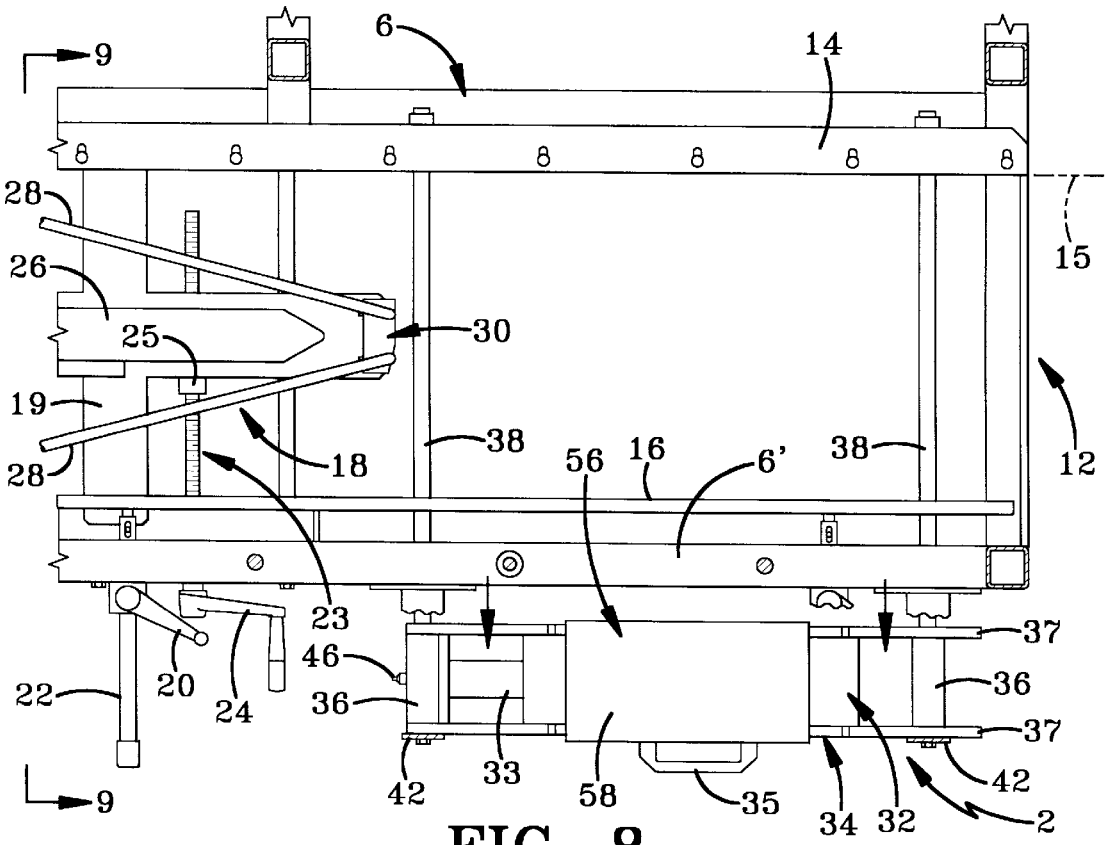
FIG. 8 is a plan view similar to FIG. 2 with the moveable tape head of the present invention in a loading position.

Cradle 34 and tape head 32 may be moved horizontally from the operational position depicted in FIG. 3 to a loading position outside the perimeter of box erecting machine 4 (FIGS. 8 and 9) at which point cradle 34 contacts and is retained by butt plates 42. With tape head 32 in the loading position depicted in FIGS. 8 and 9, tape roll 33 lies outside the perimeter of box erecting machine 4 and can be readily replaced. In accordance with the features of the present invention, in such position tape roll 33 can be more readily replaced than if tape head 32 and tape roll 33 were centered in box erecting machine 4 because tape head 32 is accessible and easy to work with.

As can be seen in the dashed lines of FIG. 1, rollers 62 of tape head 32 protrude above the lower edge of a frame member 6'. Frame 6, including frame member 6', define a structural perimeter of box erecting machine 4.

Roller 62 also protrude above adjustable guide rail 16 as shown in FIG. 3. In moving between the operational position and the loading position, cradle 34 and tape head 32 of tape head mechanism 2 must pass underneath adjustable guide rail 16 and frame member 6'. A cover plate 56 is thus used to press rollers 62 downward and into the interior of tape head 32. As is best shown in FIG. 6, cover plate 56 includes an upper plate 58 and a lower plate 60 connected by an intermediate plate 61. Lower plate 60 is substantially parallel with upper plate 58. When lower plate 60 is slipped underneath the lower edge of one of plates 37 of carriage 34, upper plate 58 depresses rollers 62 into tape head 32, thus permitting cradle 34 and tape head 32 to have clearance sufficient to slidably pass underneath guide rail 16 and frame member 6'. The upward biasing of rollers 62, as is understood in the relevant art, causes a compressive force upward on upper plate 58, thus causing lower plate 60 to engage the lower edge of plate 37 and be held in place thereon. Furthermore, intermediate plate 61 is sized to snugly fit on plate 37.

In order to move cradle 34 and tape head 32 from the operational position to the loading position, cover plate 56 is first installed onto cradle 34, thus compressing rollers 62 into tape head 32 and below frame member 6'. Pull knob 48 of pin assembly 44 is pulled in a direction away from receptacle 54 of locking plate 30 thus releasing tape head 32 from operational alignment with flap closure apparatus 18 and permitting cradle 34 and tape head 32 to slide along bars 38 to the loading position. In accordance with the features of the present invention, in returning cradle 34 and tape head 32 from the loading position to the operational position, cradle 34 is simply slid back into alignment with flap closure apparatus 18 until pin 46 engages receptacle 54.

Figure 10:
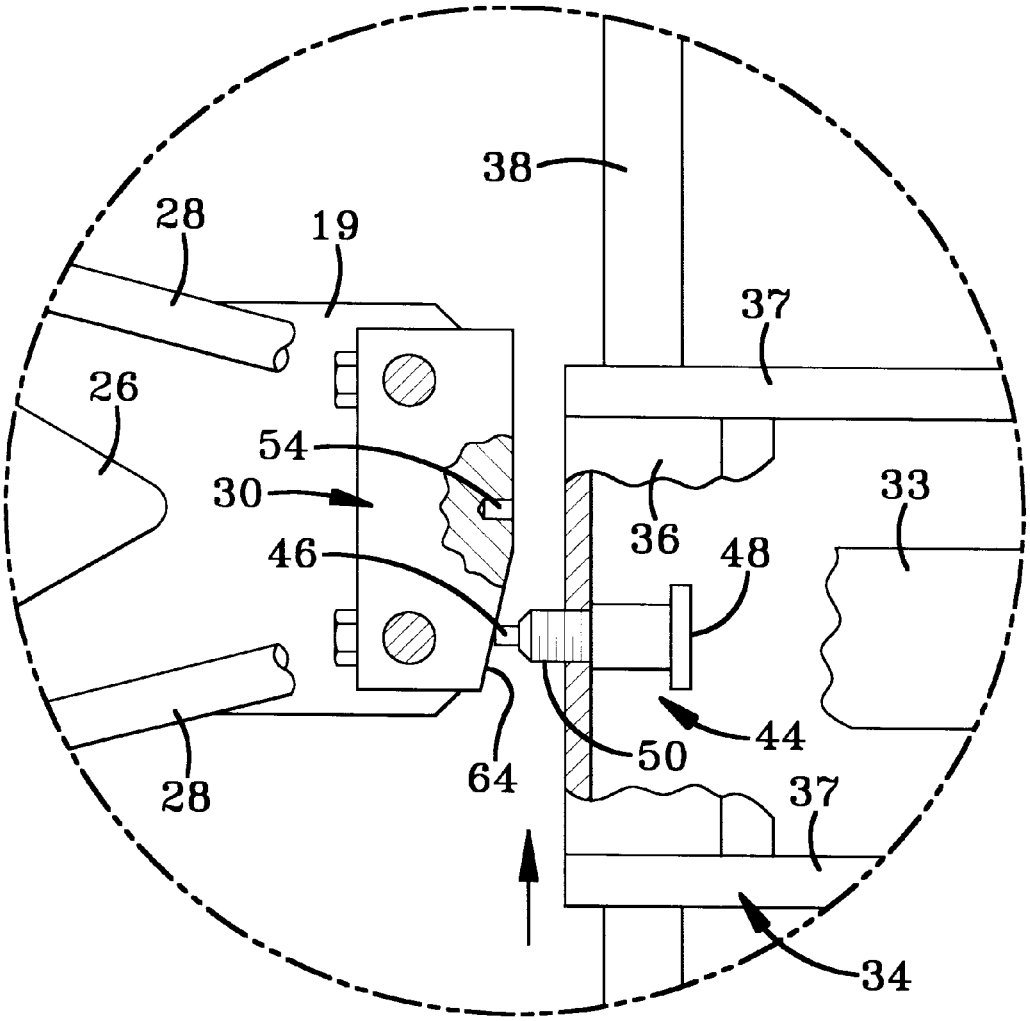
FIG. 10 is an enlarged view of a portion of the tape head mechanism of the present invention similar to FIG. 7 and showing the tape head returning from the loading position to the operational position.

As is best shown in FIG. 10, locking plate 30 has an angled ramp surface 64 that is engaged by pin 46 to depress pin 46 prior to the engagement of pin 46 in receptacle 54. Inasmuch as pin 46 is biased toward locking plate 30 by spring 52, it is understood that in returning cradle 34 to the operational position, cradle 34 is simply slid toward locking plate 30 where pin 46 engages ramp surface 64 and is translated thereby, with pin 46 ultimately returning into engagement with receptacle 54. Cover plate 56 is then removed from tape head 32, thus permitting rollers 62 to return to their original position.

In accordance with the features of the present invention, the slidable nature of tape head mechanism 2 permits tape roll 33 to be replaced outside the perimeter of box erecting machine 4 with minimal effort, and with less effort than would be required if tape roll 33 were mounted centrally within box erecting machine 4. Inasmuch as box erecting machine 4 is typically used in a massproduction environment, tape roll 33 is of an appropriate large size to reduce as much as possible the required frequency of changing tape roll 33. Such large tape rolls are of a standard size and are known and understood in the relevant art to be bulky and difficult to replace. It is also known that threading the tape of tape roll 3 into tape head 32 is a difficult task, especially when tape head 32 is disposed under or within box erecting machine 4. The positioning of tape roll 33 outside the perimeter of box erecting machine 4 when in the loading position thus allows tape roll 33 to be replaced with relative ease.

In accordance with other features of the present invention, pin assembly 44 further expedites the replacement of tape roll 33 by obviating the need to separately align tape head 32 between guide rails 14 and 16 in the operational position. Once tape roll 33 has been replaced, cradle 34 is slid along bars 38 with pin 46 engaging ramp surface 64 and returning with the biasing effect of spring 52 to engage receptacle 54. As such, once flap closure apparatus 18 has been centered between guide rails 14 and 16 by adjusting centering crank 24, cradle 34 can be repeatedly slid between operational and loading positions and tape roll 33 can be repeatedly replaced without the need to separately align tape head 32 between guide rails 14 and 16, thus resulting in significant cost and time savings.

Accordingly, the improved moveable tape head for box erecting machine invention is simplified, provides an effective, safe, inexpensive, and efficient device that achieves all the enumerated objectives, provides for eliminating difficulties encountered with prior devices, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the moveable tape head for box erecting machine invention is constructed and used, the characteristics of the construction, and the advantageous new and useful results obtained; the new and useful structures, devices, elements, arrangements, parts, and combinations are set forth in the appended Claims.

I claim:

1. A box erecting machine comprising:

a frame defining a structural perimeter of the machine;

guide means mounted on said frame for guiding the box, said guide means defining an operational perimeter of the machine;

conveyance means for conveying the box through said guide means;

a cradle selectively movably mounted on said frame;

a tape head having at least a first outwardly-biased roller, said tape head mounted in said cradle;

said cradle being selectively movable between a loading position outside said operational perimeter and an operational position inside said operational perimeter;

a pin and a corresponding receptacle, said pin being attached to one of said cradle and said frame, said receptacle being formed on the other of said cradle and said frame.

2. The box erecting machine as set forth in claim 1, further comprising a crank assembly mounted on said frame, said pin attached to one of said cradle and said crank assembly, said receptacle formed on the other of said cradle and said crank assembly.

3. The box erecting machine as set forth in claim 2, further comprising a pair of bars attached at one end thereof to said frame, said cradle slidably mounted on said bars and selectively movable between said loading and operational positions.

4. The box erecting machine as set forth in claim 3 in which said cradle is horizontally movable between said loading and operational positions.

5. The box erecting machine as set forth in claim 4 in which said pin is biased toward said receptacle.

6. The box erecting machine as set forth in claim 5, further comprising a ramp surface formed on one of said of said cradle and said crank assembly, said receptacle formed adjacent said ramp surface.

7. The box erecting machine as set forth in claim 6 in which said ramp surface is formed on said crank assembly.

8. In a box erecting machine having a frame, the frame defining a structural perimeter, guide means mounted on the frame for guiding a box, the guide means defining an operational perimeter, conveyance means for conveying the box through the guide means, and a tape head mounted on the frame, the tape head having at least a first outwardly-biased roller, the improvement comprising:

a tape head mechanism having a cradle;

said tape head mechanism mounted on the frame;

the tape head mounted in said cradle;

said cradle being selectively moveable between a loading position outside the operational perimeter and an operational position inside the operational perimeter; and a pin and a corresponding receptacle, said pin attached to one of said cradle and the frame, said receptacle formed on the other of said cradle and the frame.

9. The improvement as set forth in claim 8, further comprising a crank assembly mounted on the frame, said pin attached to one of said cradle and said crank assembly, said receptacle formed on the other of said cradle and said crank assembly.

10. The improvement as set forth in claim 2, further comprising a pair of bars attached at one end thereof to the frame, said cradle slidably mounted on said bars and selectively moveable between said loading and operational positions.

11. The improvement as set forth in claim 10 in which said cradle is horizontally movable between said loading and operational positions.

12. The improvement as set forth in claim 9 in which said pin is biased toward said receptacle.

13. The improvement as set forth in claim 12, further comprising a ramp surface formed on one of said cradle and said crank assembly, said receptacle being formed adjacent said ramp surface.

14. The improvement as set forth in claim 13 in which said ramp surface is formed on said crank assembly.

15. In a box erecting machine having a frame, the frame defining a structural perimeter, guide means mounted on the frame for guiding a box, the guide means defining an operational perimeter extending in vertical reference planes at the edges of the guide means, conveyance means for conveying the box through the guide means, and a tape head mounted on the frame, the tape head having at least a first outwardly-biased roller, the improvement comprising:

a tape head mechanism having a cradle;

a pair of bars attached at one end thereof to the frame, said cradle slidably mounted on the bars and selectively moveable between loading and operational positions;

the tape head mounted in said cradle;

said loading position being outside said operational perimeter and said operational position being inside the operational perimeter; said loading position being displaced in at least a horizontal direction with respect to said operational position; and a cover plate, said cover plate sized to be selectively mounted and retained on said cradle and to compress the outwardly-biased roller inwardly toward the tape head.

16. The improvement of claim 15 further comprising a pin and a corresponding receptacle, the pin being mounted on one of the cradle and the frame, the receptacle being formed on the other of the cradle and the frame; the pin being selectively received in the receptacle.

17. The improvement of claim 15, wherein the cradle is moved between the loading position and operational position along a horizontal path.

18. The improvement of claim 15, wherein the loading position is disposed outside of the structural perimeter of the frame.

19. In a box erecting machine having a frame, the frame defining a structural perimeter, guide means mounted on the frame for guiding a box, the guide means defining an operational perimeter extending in vertical reference planes at the edges of the guide means, conveyance means for conveying the box through the guide means, and a tape head mounted on the frame, the tape head having at least a first outwardly-biased roller, the improvement comprising:

a tape head mechanism having a cradle;

the tape head mounted in said cradle;

a pair of bars attached at one end thereof to the frame, said cradle slidably mounted on said bars and selectively moveable between loading and operational positions;

said loading position being outside the structural perimeter; and said cradle being selectively moveable between said loading position and said operational position; said loading position being displaced in at least a horizontal direction with respect to said operational position.

20. The improvement of claim 19, wherein the cradle moves between the loading position and the operational position along a horizontal path.

21. The improvement of claim 19, further comprising a pin and a corresponding receptacle, the pin being mounted to one of the cradle and the frame, the receptacle formed on the other of the cradle and the frame; the pin being selectively received in the receptacle.

22. The improvement of claim 21, wherein the pin is biased toward the receptacle.

23. The improvement of claim 19 in combination with a cover plate, the cover plate being sized to be selectively mounted and retained on the cradle and compress the outwardly-biased roller inwardly toward the tape head.

24. The improvement of claim 19 further comprising a crank assembly mounted on the frame; the crank assembly being adapted to move the tape head mechanism between the loading and operational positions.

25. A tape head mechanism for mounting a tape head to a frame of a box erecting machine, the tape head having at least a first outwardly-biased roller, the frame defining a structural perimeter, the box erecting machine having guide means defining an operational perimeter, said tape head mechanism comprising:

a cradle mounted on the frame and selectively moveable between a loading position outside the operational perimeter and an operational position inside the operational perimeter;

the tape head being mounted in said cradle; and a pin and a corresponding receptacle, said pin attached to one of said cradle and the frame, said receptacle formed in the other of said cradle and the frame.

26. The tape head mechanism as set forth in claim 25, further comprising a crank assembly mounted on the frame, said pin attached to one of said cradle and said crank assembly, said receptacle formed in the other of said cradle and said crank assembly.

27. The tape head mechanism as set forth in claim 26, further comprising a pair of bars fixedly attached at one end thereof to said frame, said cradle selectively slidably mounted on said bars and movable between said loading and operational positions.

28. The tape head mechanism as set forth in claim 27 in which said cradle is horizontally movable between said loading and operational positions.

29. The tape head mechanism as set forth in claim 26, in which said pin is biased toward said receptacle.

30. The tape head mechanism as set forth in claim 29, further comprising a ramp surface formed on one of said cradle and said crank assembly, said receptacle being formed adjacent said ramp surface.

31. The tape head mechanism as set forth in claim 30 in which said loading position is outside the structural perimeter.

32. The tape head mechanism as set forth in claim 31 in which said ramp surface is formed on said crank assembly.

33. The tape head mechanism as set forth in claim 32 in combination with a cover plate, said cover plate sized to be selectively mounted and retained on said cradle and compress the roller inwardly toward the tape head.

* * * * *